US005326399A

United States Patent [19]

Takamura

[11] Patent Number: 5,326,399

[45] Date of Patent: Jul. 5, 1994

[54] BOOTH STRUCTURE FOR COATING CATHODE-RAY TUBE HAVING DUST ABSORBING WALL SURFACES

[75] Inventor: Takumi Takamura, Gifu, Japan

[73] Assignee: Sony Corporation, Tokyo, Japan

[21] Appl. No.: 924,516

[22] Filed: Aug. 4, 1992

[30] Foreign Application Priority Data

Aug. 6, 1991 [JP] Japan ..... 3-196870

[51] Int. Cl.[5] ..... B05C 15/00

[52] U.S. Cl. ..... 118/64; 118/326; 118/DIG. 7

[58] Field of Search ..... 118/300, 301, 326, DIG. 7, 118/64, 500, 634; 427/64, 421

[56] References Cited

U.S. PATENT DOCUMENTS

| | | | |
|---|---|---|---|
| 2,959,493 | 11/1960 | Vincent | 427/64 |
| 3,048,146 | 8/1962 | Coppola | 427/64 |
| 4,173,924 | 11/1979 | Bradshaw | 118/DIG. 7 |
| 4,460,621 | 7/1984 | Pearlman | 427/64 |
| 4,581,561 | 4/1986 | Palac | 313/474 |
| 4,616,594 | 10/1986 | Itho | 118/DIG. 7 |
| 4,715,314 | 12/1987 | Ramseier et al. | 118/DIG. 7 |
| 4,729,907 | 3/1988 | Deal et al. | 427/64 |
| 4,735,170 | 4/1988 | Deal | 118/301 |
| 4,884,004 | 11/1989 | Deal et al. | 313/402 |

FOREIGN PATENT DOCUMENTS

| | | | |
|---|---|---|---|
| 2-79321 | 3/1990 | Japan | 427/64 |

*Primary Examiner*—Joseph W. Drodge
*Attorney, Agent, or Firm*—Hill, Steadman & Simpson

[57] ABSTRACT

A coating device for coating a cathode-ray tube with a layer has a booth for accommodating a cathode-ray tube to be coated. The booth houses a coating robot with a spray nozzle for spraying a coating solution onto the cathode-ray tube in the booth to coat a layer on the cathode-ray tube. The inner wall surfaces of the booth are lined with a water-containing member which is supplied with water from a water supply pipe connected to the booth. An air-conditioning unit is mounted on the booth for controlling the temperature and humidity in the booth. The cathode-ray tube is introduced into the booth from a conveyor through an opening defined in a wall of the booth and fitted with a selectively closable door.

9 Claims, 6 Drawing Sheets

BOOTH STRUCTURE FOR COATING CATHODE-RAY TUBE HAVING DUST ABSORBING WALL SURFACES

BACKGROUND OF THE INVENTION

1. Field of the Invention

The present invention relates to a coating device for coating the surface of the screen panel of a cathode-ray tube with a sprayed layer such as an anti-static layer, an anti-dazzling layer, or the like, and more particularly to a booth structure for such a coating device.

2. Description of the Prior Art

Cathode-ray tubes have screen panels coated with an anti-dazzling layer for preventing the screen panel from glaring with reflections and/or an anti-static layer for preventing the screen panel from being electrostatically charged with the scanning electron beam emitted from the electron gun of the cathode-ray tube. These anti-dazzling and anti-static layers may be coated according to the spray coating process.

Spray coating devices comprise a booth which houses therein a support base for supporting an object, such as a cathode-ray tube, to be coated and a coating robot having a spray nozzle on its arm which is positioned in confronting relationship to the screen panel of the cathode-ray tube on the support base. In operation, the coating robot moves the spray nozzle to scan the object while spraying a coating solution from the nozzle onto the screen panel to form ether an anti-dazzling layer or an anti-static layer on the screen panel.

When the coating Solution is sprayed over the screen panel, dust particles in the booth tend to be stirred up and entrained by the sprayed solution. The entrained dust particles are applied, together with the coating solution, to the screen panel. As a result, the quality of the coated layer on the screen panel may possibly be lower than it should be.

The anti-dazzling or anti-static layer coated on the screen panel of a cathode-ray tube is required to be less glaring than lustrous or more glossy than anti-glaring, depending on the kind of the cathode-ray tube. The inventor has found that a coating layer can be selected through the control of coating conditions.

OBJECTS AND SUMMARY OF THE INVENTION

It is an object of the present invention to provide a coating device which is capable of coating the screen panel of a cathode-ray tube with a high-quality layer such as an anti-dazzling layer, an anti-static layer, or the like in good coating environments, and also of controlling the type of the coating layer on the screen panel.

According to the present invention, there is provided a coating device for coating a cathode-ray tube with a layer, comprising a booth for accommodating a cathode-ray tube to be coated, spraying means in the booth for spraying a coating solution onto the cathode-ray tube in the booth to coat a layer on the cathode-ray tube, a water-containing member mounted on inner wall surfaces of the booth, and water supply means connected to the booth for supplying water to the water-containing member. The water-containing member comprises sponge walls attached respectively to the inner wall surfaces of the booth, and water feed pipes disposed in the sponge walls and connected to the water supply means. The booth may have a slanted upper wall, one of the sponge walls being attached complementarily to the slanted upper wall.

According to the present invention, there is provided a coating device for coating a cathode-ray tube with a layer, comprising a booth for accommodating a cathode-ray tube to be coated, spraying means in the booth for spraying a coating solution onto the cathode-ray tube in the booth to coat a layer on the cathode-ray tube, air-conditioning means coupled to the booth for controlling the temperature and humidity in the booth, and air discharging means for discharging air out of the booth. The air-conditioning means includes an air outlet opening into the booth for supplying air directly toward the cathode-ray tube. The air discharging means comprises a hood disposed in the booth for covering the cathode-ray tube, and an air discharge port defined in a wall of the booth adjacent to the hood.

According to the present invention, there is further provided a coating device for coating a cathode-ray tube with a layer, comprising a conveyor for conveying a cathode-ray tube, a booth for accommodating the cathode-ray tube introduced by the conveyor, the booth having an opening defined in a wall thereof for introducing the cathode-ray tube from the conveyor through the opening into the booth, and a selectively openable door disposed in the opening, and spraying means in the booth for spraying a coating solution onto the cathode-ray tube in the booth to coat a layer on the cathode-ray tube. The conveyor may be disposed on one side of the booth, or extend through the booth.

The above and other objects, features, and advantages of the present invention will become apparent from the following description of illustrative embodiments thereof to be read in conjunction with the accompanying drawings, in which like reference numerals represent the same or similar objects.

DETAILED DESCRIPTION OF THE PREFERRED EMBODIMENTS

Figure 1:
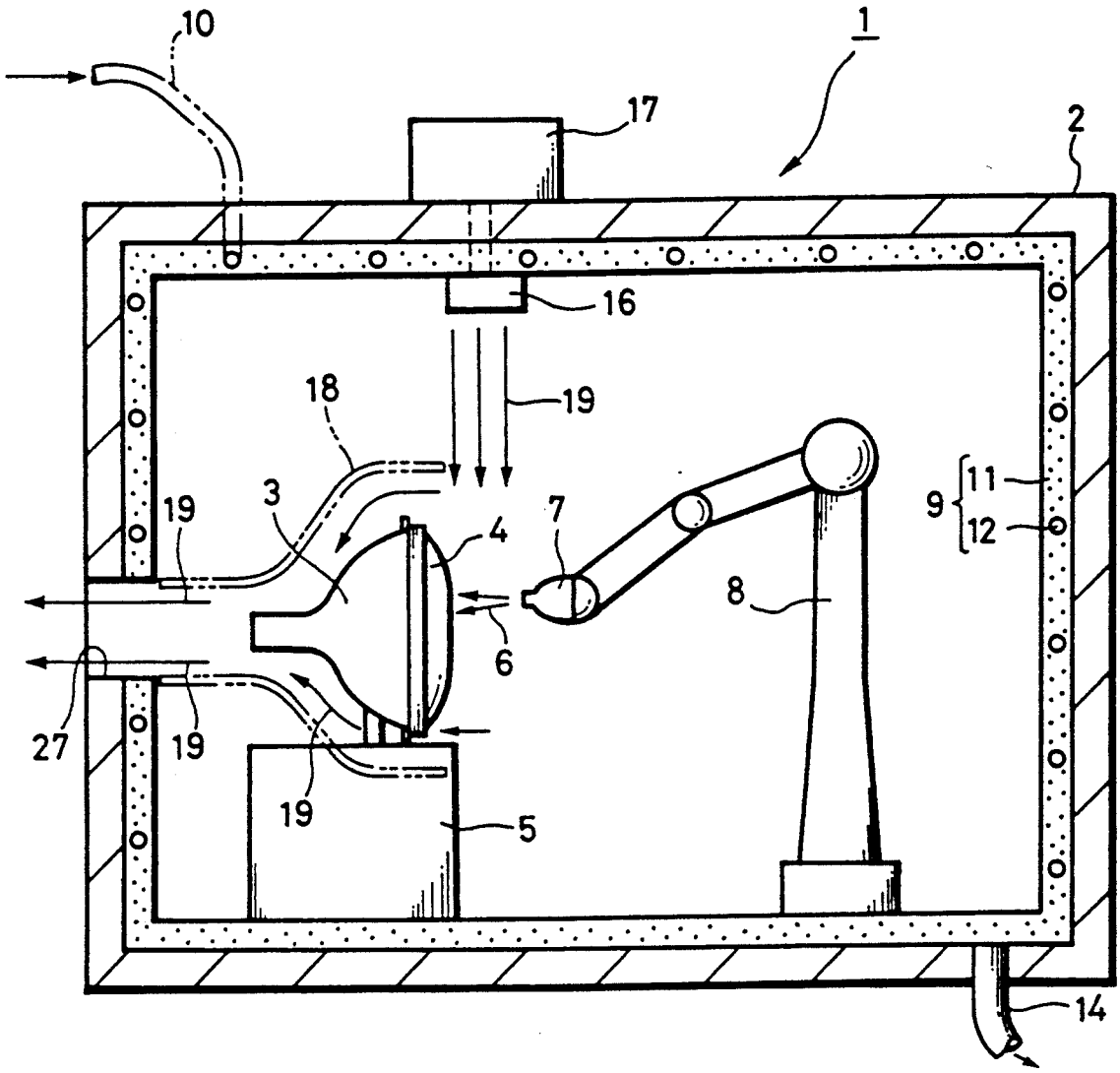
FIG. 1 is a cross-sectional view of a coating device according to an embodiment of the present invention.

FIG. 1 shows a coating device according to an embodiment of the present invention. The coating device, generally designated by the reference numeral 1, has a substantially fully closed booth 2. The booth 2 houses therein a support base 5 for supporting a cathode-ray tube 3 with an implosion-resistant band such that a screen panel 4 thereof lies vertically, and a coating robot 8 having on its arm a spray nozzle 7 for ejecting a coating solution 6. The spray nozzle 7 is disposed in confronting relationship to the screen panel 4, and can be moved by the coating robot 8 to scan the screen panel 4 vertically and horizontally. The inner wall surfaces of the booth 2 are lined with a water-containing member 9, which is a layer of sponge and which member 9 is coupled to a water supply pipe 10.

Figure 2:
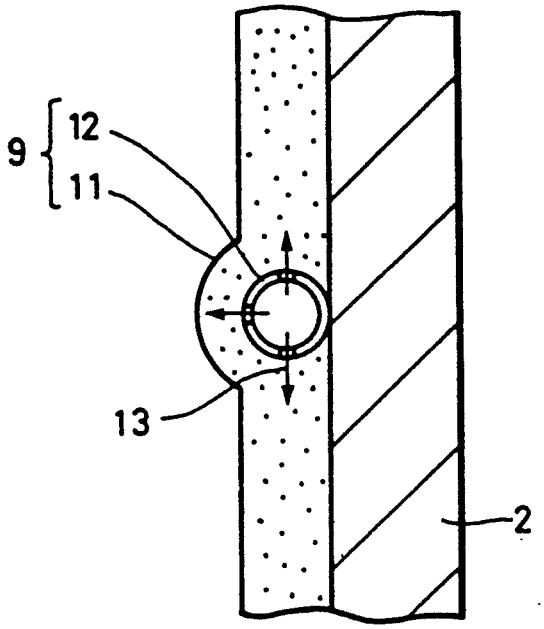
FIG. 2 is an enlarged fragmentary cross-sectional view of a booth of the coating device shown in FIG. 1.

The water-containing member 9 serves to prevent dust particles from being stirred up in the booth 2. As better shown in FIG. 2, the water-containing member 9 comprises upper, lower, and side sponge walls 11 (only one shown in FIG. 2) attached respectively to the upper, lower, and side walls of the booth 2, and water feed pipes 12 (only one shown in FIG. 2) disposed in and extending through the sponge walls 11. The water feed pipes 12 have small holes defined in their walls. The water feed pipes 12 are connected to the water supply pipe 10 so that water 13 can be supplied from the water feed pipes 12 through the holes therein into the sponge walls 11. All the upper, lower, and side sponge walls 11 may be supplied with water from the water feed pipes 12. However, only the lower and side sponge walls 11 may be supplied with water from the water feed pipes 12 so that no water will drop from the upper sponge wall 11 into the booth 2. The booth 2 has a water drain port 14 in its lower wall.

Figure 3:
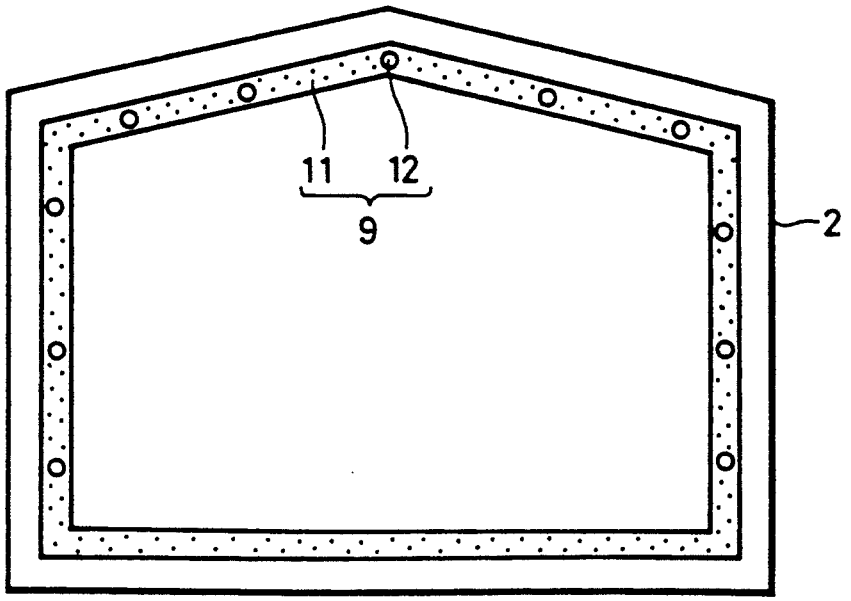
FIG. 3 is a cross-sectional view of a booth according to another embodiment of the present invention.

FIG. 3 shows another booth 2 combined with a water-containing member 9. The booth 2 includes a slanted upper wall of inverted V-shaped cross section. In FIG. 3, the water-containing member 9 has an upper sponge wall 11 attached complementarily to the slanted upper wall. The upper sponge wall 11 may be supplied with water from the water feed pipes 12 because water supplied to the upper sponge wall 11 flows downwardly through the upper sponge wall 11, but does not drop into the booth 2*a*.

As shown in FIG. 1, an air-conditioning unit 17 is mounted on the upper wall of the booth 2. The air-conditioning unit 17 has an air outlet 16 positioned above the screen panel 4 of the cathode-ray tube 3 supported on the support base 5. The air outlet 16 is fitted with an air filter (not shown) of class 100000. The air-conditioning unit 17 controls the temperature and humidity in the booth 2 through the air outlet 16. While the coating solution 6 is being sprayed onto the screen panel 4 of the cathode-ray tube 3, the air-conditioning unit 17 supplies temperature- and humidity-controlled clean air 19 through the air outlet 16 to the surface of the screen panel 4. The supplied air is then discharged through a hood 18 and an air discharge port 27 defined in one of the side walls of the booth 2 adjacent to the hood 18. The hood 18, which is movable in the booth 2, is brought into covering relationship to the cathode-ray tube 3 when the cathode-ray tube 3 is placed on the support base 5.

Figure 4:
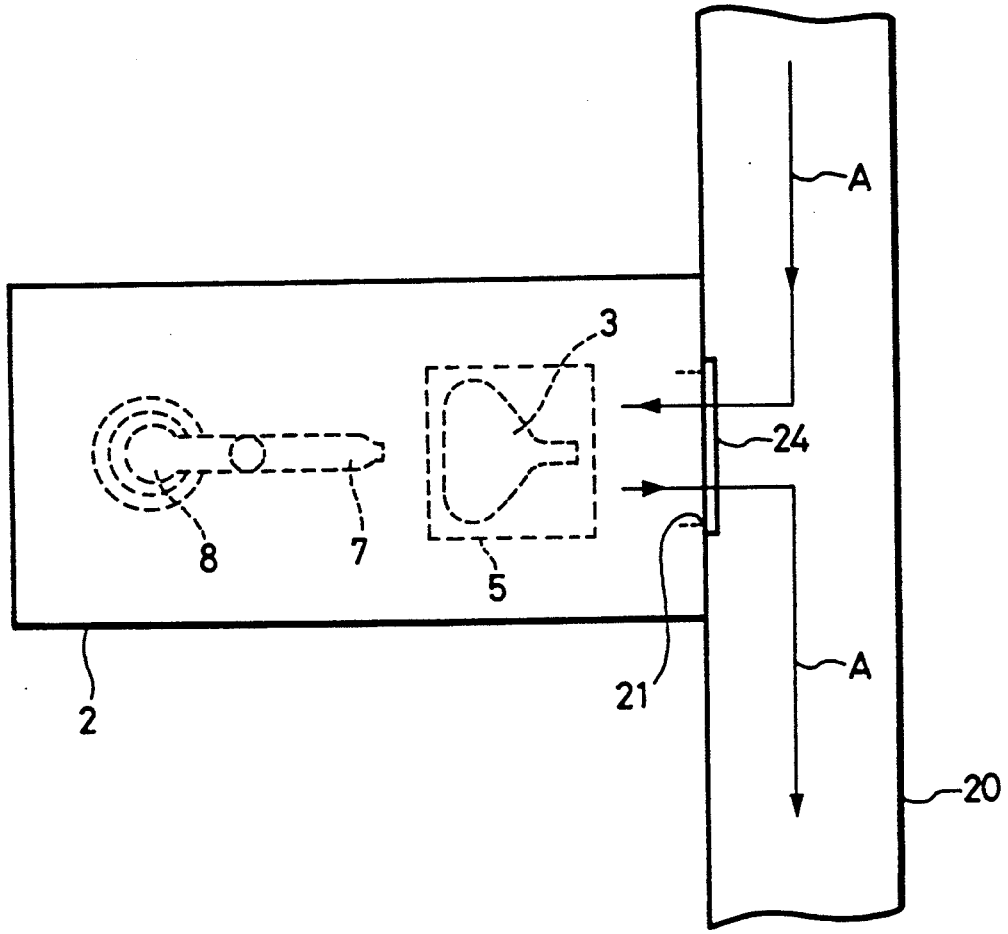
FIG. 4 is a plan view showing a layout for the coating device shown in FIG. 1.
Figure 5:
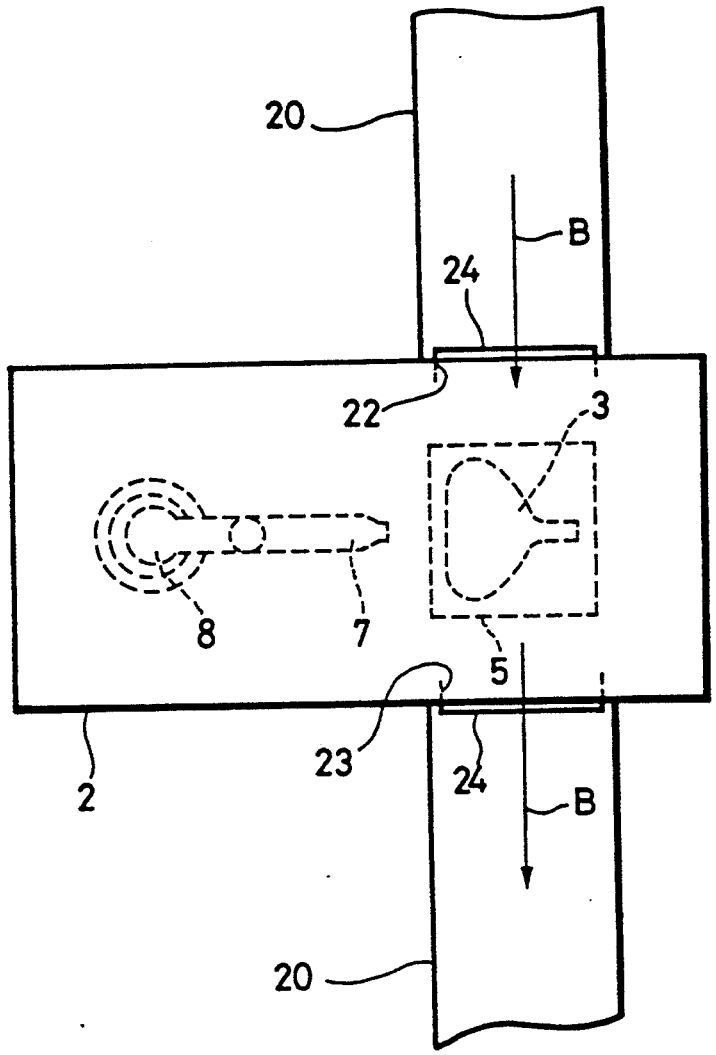
FIG. 5 is a plan view showing another layout for the coating device shown in FIG. 1.

The booth 2 is combined with a conveyor for conveying the cathode-ray tube 3 into the booth 2. FIGS. 4 and 5 show different layouts for the booth 2 and the conveyor.

More specifically, in FIG. 4, the conveyor, denoted at 20, is disposed on one side of the booth 2. In operation, the cathode-ray tube 3 is conveyed by the conveyor 20 therealong. When the cathode-ray tube 3 reaches the booth 2, it is introduced into the booth 2 through a loading/unloading opening 21 defined in one of the side walls of the booth 2. After the screen panel 4 of the cathode-ray tube 3 has been coated, the cathode-ray tube 3 is moved out of the booth 2 through the loading/unloading opening 21 onto the conveyor 20, and then conveyed to a next processing station by the conveyor 20. Thus, the cathode-ray tube 3 is conveyed by the conveyor 20 and moved into and out of the booth 2 along the directions indicated by the arrows A.

In FIG. 5, the conveyor 20 extends through the booth 2. In operation, the cathode-ray tube 3 is conveyed by the conveyor 20 therealong. When the cathode-ray tube 3 reaches the booth 2, it is introduced into the booth 2 through a loading opening 22 defined in one of the side walls of the booth 2. After the screen panel 4 of the cathode-ray tube 3 has been coated, the cathode-ray tube 3 is moved out of the booth 2 through an unloading opening 23, which is defined in an opposite side wall of the booth 2, onto the conveyor 20, and then conveyed to a next processing station by the conveyor 20. Thus, the cathode-ray tube 3 is conveyed by the conveyor 20 and moved into and out of the booth 2 along the directions indicated by the arrows B.

In the layouts shown in FIGS. 4 and 5, the loading-/unloading opening 21, the loading opening 22, and the unloading opening 23 are fitted with respective selectively openable doors 24 such as shutters. After the cathode-ray tube 3 has been introduced into the booth 2, the doors 24 are closed to isolate the interior of the booth 2 from the exterior space. After the screen panel 4 of the cathode-ray tube 3 has been coated, the doors 24 are opened to allow the cathode-ray tube 3 to be unloaded from the booth 2 back to the conveyor 20.

Figure 6B:
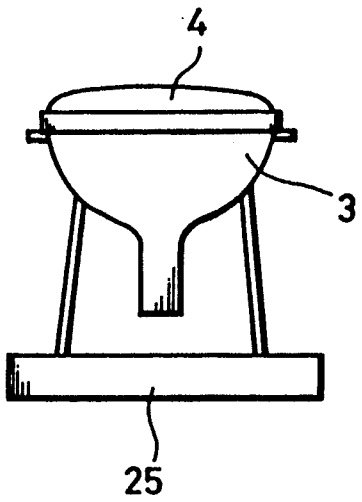
FIGS. 6A and 6B are side elevational views showing different manners in which cathode-ray tubes are conveyed by a conveyor.
Figure 6A:
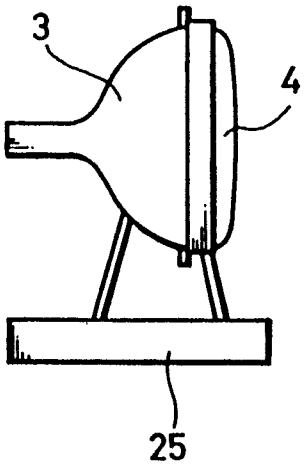

As shown in FIGS. 6A and 6B, the cathode-ray tube 3 is supported on a pallet 25 while being conveyed by the conveyor 20. In FIG. 6A, the cathode-ray tube 3 is supported on the pallet 25 with its screen panel 4 lying vertically. In FIG. 6B, the cathode-ray tube 3 is supported on the pallet 25 with its screen panel 4 lying horizontally.

Operation of the coating device 1 shown in FIG. 1 will be described below.

The clean air 19 whose temperature and humidity have been controlled by the air-conditioning unit 17 is supplied through the air outlet 16 into the booth 2, thereby controlling the temperature and humidity in the booth 2 to be suitable values, respectively. Then, the coating solution 6 for producing an anti-dazzling layer, an anti-static layer, or the like is sprayed from the spray nozzle 7 onto the screen panel 4 of the cathode-ray tube 3. At the same time, the spray nozzle 7 is moved vertically and horizontally by the coating robot 8 to scan the screen panel 4 along a zigzag pattern, for example.

While the coating solution 6 is being sprayed onto the screen panel 4, dust particles floating in the booth 2 are attracted to the water-containing member 9 on the inner wall surfaces of the booth 2. Therefore, dust particles in the booth 2 are prevented from being entrained by the coating solution 6, and hence from being applied to the screen panel 4. As the air outlet 16 is located relatively near the screen panel 4, the screen panel 4 is kept clean by the clean air 19 that is supplied downwardly from the air outlet 16 and applied directly to the screen panel 4. Therefore, the clean air 19 is also effective for preventing dust particles from being attached to the screen panel 4 when it is coated with the coating solution 6. The coating layer formed on the screen panel 4 is thus made less defective and higher in quality.

The coating solution 6 applied to the screen panel 4 can be dried at different rates and hence the resulting coating layer on the screen panel 4 can have different degree of surface roughness depending on the temperature of the screen panel 4 and the temperature and humidity in the booth 2. When the coating solution is dried at a higher rate, the surface roughness of the dried coating layer is larger, and the coating layer is more anti-dazzling. When the coating solution is dried at a lower rate, since it tends to sag and spread, the surface roughness of the dried coating layer is smaller, and the coating layer is more glossy. To manufacture non-glare cathode-ray tubes, it is necessary to form a highly anti-dazzling layer on the screen panels of the cathode-ray tubes. On the other hand, to manufacture cathode-ray tubes which can display sharp images in bright environments, it is necessary to form a glossy layer on the screen panels of the cathode-ray tubes though the glossy layer may be less anti-dazzling. The temperature and humidity in the booth 2 are important as coating conditions to produce such different coating layers on the screen panels of cathode-ray tubes.

The temperature and humidity in the booth 2 can be controlled by the air-conditioning unit 17 which controls the temperature and humidity of the clean air 19 to be introduced through the air outlet 16 into the booth 2 and also by the air discharge port 27. Therefore, the rate at which the coating solution 6 on the screen panel 4 is dried can be controlled to form a desired coating layer on the screen panel 4. The air-conditioning unit 17 controls the humidity in the booth 2 in view of the humidifying effect of the water-containing member 9 as the water contained in the water-containing member 9 tends to vaporize into the booth 2.

Figure 7:
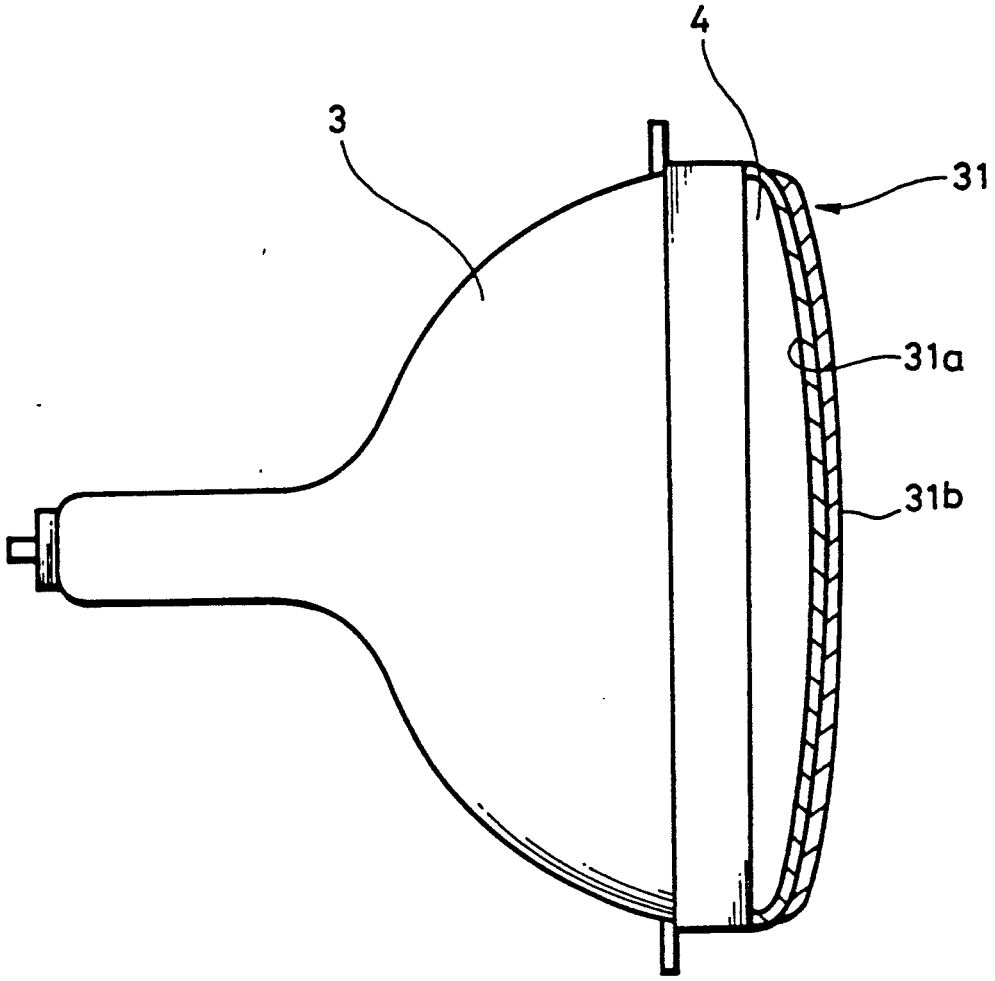
FIG. 7 is an enlarged side elevational view, partly in cross section, of a cathode-ray tube which has been coated with an anti-dazzling layer by the coating device according to the present invention.

FIG. 7 shows a cathode-ray tube 3 having a screen panel 4 coated with a double-layer anti-dazzling layer 31 which is composed of a visible-light absorbing layer 31*a* containing a black dye and an anti-static layer 31*b* containing an inorganic metal compound.

Now, a process of manufacturing the double-layer anti-dazzling layer 31 shown in FIG. 7 will be described below.

The cathode-ray tube 3 that has been manufactured according to the normal fabrication process is placed in the booth 2 while the screen panel 4 is being maintained at a predetermined temperature. An ethyl silicate solution containing 0.1 to 0.5 wt % of a black dye mainly composed of carbon powder and 1 to 10 wt % of light-dispersing $SiO_2$ powder is sprayed onto the screen panel 4 at a rate ranging from 0.2 to 0.5 ml/sec., thus forming the visible-light absorbing layer 31*a*.

Then, an ethyl silicate solution containing 40 to 60% of powder of an electrically conductive metal oxide such as of tin oxide, indium oxide, or the like and 1 to 10 wt % of light-dispersing $SiO_2$ powder is sprayed onto the visible-light absorbing layer 31*a* on the screen panel 4 at a rate ranging from 0.2 to 0.5 ml/sec., thus forming the anti-static layer 31*b*.

Thereafter, the layers 31*a*, 31*b* are baked at a temperature ranging from 150° to 200° C. for a time period ranging from 10 to 30 minutes, vaporizing the ethyl component. The double-layer anti-dazzling layer 31 is now completed.

When the ethyl silicate solutions are applied to form the visible-light absorbing layer 31*a* and the anti-static layer 31*b*, double-layer anti-dazzling layers 31 of different properties may be produced by controlling the temperature of the screen panel 4 and the temperature and humidity in the booth 2.

Specifically, if the screen panel 4 is of a temperature of or lower than 100° C., e.g., of about 45° C., and the temperature and humidity in the booth 2 are 25°±5° C. and 50 to 60%, respectively, then the coated anti-dazzling layer 31 is high in its anti-dazzling effect.

If the screen panel 4 is of a temperature of 30°±10° C., e.g., of about 30° C., and the temperature and humidity in the booth 2 are 25°±5° C. and 70±10%, respectively, then the coated anti-dazzling layer 31 is low in its anti-dazzling effect and highly glossy, e.g., has a gloss value of 80 or more.

As shown in FIGS. 4 and 5, after the cathode-ray tube 3 has been introduced into the booth 2, the door 24 in the loading/unloading opening 21 or the doors in the loading and unloading openings 22, 23 are closed to isolate the interior of the booth 2 from the exterior space, as described above. Since the booth 2 is substantially fully closed, the temperature and humidity in the booth 2 can be easily controlled, and the coating solution 6 can be applied neatly to the screen panel 4 while the clean air 19 is being supplied constantly without disturbance. Consequently, the coated layer on the screen panel is high in quality. The cathode-ray tube with the high-quality coated layer is highly reliable in operation.

The coating device 1 according to the present invention may be used to form a single anti-static layer or a single anti-dazzling layer, rather than the double-layer anti-dazzling layer 31, on the screen panel 4.

Having described preferred embodiments of the invention with reference to the accompanying drawings, it is to be understood that the invention is not limited to that precise embodiments and that various changes and modifications could be effected by one skilled in the art without departing from the spirit or scope of the invention as defined in the appended claims.

What is claimed is:

1. A coating device for coating a cathode-ray tube with a layer, comprising:

a booth having means for supporting a cathode-ray tube to be coated, said booth having sidewalls and an upper wall;

spraying means in said booth for spraying a coating solution onto the cathode-ray tube so as to form a layer on the cathode-ray tube;

water-containing means for absorbing dust particles floating in said booth being mounted on inner wall surfaces of said booth; and water supply means for supplying water to said water-containing means being connected to said booth.

2. A coating device according to claim 1, wherein said water-containing means comprises sponge walls attached respectively to said inner wall surfaces of said booth, and water feed pipes disposed in said sponge walls and connected to said water supply means.

3. A coating device according to claim 2, wherein said upper wall is a slanted upper wall and one of said sponge walls being attached complementarily to said slanted upper wall.

4. A coating device according to claim 1, further comprising air-conditioning means being connected to the booth for controlling the temperature and humidity in the booth, said air-conditioning means having a filter and having exhaust means connected to a discharge port of the booth for exhausting the interior of the booth.

5. A coating device according to claim 4, wherein the air-conditioning means includes an air outlet opening into the booth to supply air directly toward the cathode-ray tube.

6. A coating device according to claim 4, wherein the exhaust means includes a hood disposed in said booth adjacent the discharge port for covering the cathode-ray tube.

7. A device according to claim 1, wherein at least one wall of the booth has an opening with a door and the device has conveyor means for conveying and introducing the cathode-ray tubes through the opening to the means for supporting.

8. A coating device according to claim 7, wherein said conveyor means is disposed on one side of said booth.

9. A coating device according to claim 7, wherein said booth has two walls with openings and said conveyor means extends through said two openings of the booth.

* * * * *